US011337512B2

(12) United States Patent
Kaicker

(10) Patent No.: US 11,337,512 B2
(45) Date of Patent: May 24, 2022

(54) METHODS OF PROVIDING A COSMETIC BRUSH

(71) Applicant: Anisa International, Inc., Atlanta, GA (US)

(72) Inventor: Anisa Telwar Kaicker, Atlanta, GA (US)

(73) Assignee: Anisa International, Inc., Atlanta, GA (US)

( * ) Notice: Subject to any disclaimer, the term of this patent is extended or adjusted under 35 U.S.C. 154(b) by 36 days.

(21) Appl. No.: 16/899,038

(22) Filed: Jun. 11, 2020

(65) Prior Publication Data

US 2020/0297105 A1 Sep. 24, 2020

Related U.S. Application Data

(62) Division of application No. 15/457,501, filed on Mar. 13, 2017, now Pat. No. 10,736,410.

(Continued)

(51) Int. Cl.

| | |
|---|---|
| ***A46D 1/00*** | (2006.01) |
| ***A46D 1/05*** | (2006.01) |
| ***A46D 3/00*** | (2006.01) |
| ***A46B 9/02*** | (2006.01) |
| ***A45D 40/26*** | (2006.01) |
| ***A46D 1/055*** | (2006.01) |

(52) U.S. Cl.

CPC ..... *A46B 9/021* (2013.01); *A45D 40/262* (2013.01); *A46B 9/028* (2013.01); *A46D 1/0207* (2013.01); *A46D 1/0238* (2013.01); *A46D 1/0276* (2013.01); *A46D 1/05* (2013.01); *A46D 1/055* (2013.01); *A46D 3/00* (2013.01); *A46B 2200/1046* (2013.01)

(58) Field of Classification Search

CPC . A46B 9/021; A46B 9/028; A46B 2200/1046; A45D 40/262; A46D 1/0238; A46D 1/0276; A46D 1/05; A46D 1/055

See application file for complete search history.

(56) References Cited

U.S. PATENT DOCUMENTS

| | | | |
|---|---|---|---|
| 2,317,485 | A | 4/1943 | Rider |
| 4,733,425 | A | 3/1988 | Hartel et al. |

(Continued)

FOREIGN PATENT DOCUMENTS

| | | |
|---|---|---|
| KR | 101024089 | 12/2009 |
| WO | 2017160807 | 9/2017 |

OTHER PUBLICATIONS

Kaicker, Anisa Telwar; Final Office Action for U.S. Appl. No. 15/457,501, filed Mar. 13, 2017, dated Aug. 16, 2019, 9 pgs. **Note: copy not provided as part of PTO records.

(Continued)

*Primary Examiner* — Randall E Chin

(74) *Attorney, Agent, or Firm* — Taylor English Duma LLP

(57) ABSTRACT

Example aspects of a method of providing a cosmetic brush for use in the application of cosmetics are disclosed. The method can comprise the steps of extruding a plurality of elongate brush bristles each having a triangular transverse cross section, such that each of said elongate brush bristles defines three substantially parallel edges along the length of each of said the bristles; and combining said plurality of said bristles to provide a brush head configured for the application of cosmetics.

17 Claims, 5 Drawing Sheets

Related U.S. Application Data

(60) Provisional application No. 62/308,852, filed on Mar. 15, 2016.

(56) References Cited

U.S. PATENT DOCUMENTS

| | | | | |
|---|---|---|---|---|
| 5,195,546 | A * | 3/1993 | Cansler | A45D 33/00 132/317 |
| 5,238,011 | A | 8/1993 | Gueret | |
| 5,567,072 | A | 10/1996 | Dunleavy et al. | |
| 6,033,143 | A | 3/2000 | Gueret | |
| 6,210,059 | B1 | 4/2001 | Ramin et al. | |
| 6,367,114 | B1 | 4/2002 | Babkowski | |
| 7,752,702 | B2 | 7/2010 | Nakamura et al. | |
| 7,886,397 | B2 | 2/2011 | Gueret | |
| 9,033,604 | B2 | 5/2015 | Gueret | |
| 9,033,605 | B2 | 5/2015 | Gueret | |
| 10,736,410 | B2 | 8/2020 | Kaicker | |
| 10,939,748 | B2 | 3/2021 | Kaicker | |
| 11,197,539 | B2 | 12/2021 | Kaicker et al. | |
| 2003/0182750 | A1* | 10/2003 | Nishida | A46D 3/05 15/193 |
| 2004/0112400 | A1 | 6/2004 | Kurek | |
| 2008/0073968 | A1 | 3/2008 | Shiina | |
| 2009/0038094 | A1 | 2/2009 | Kim | |
| 2009/0142125 | A1* | 6/2009 | Henrikson | A46B 3/16 401/129 |
| 2012/0301210 | A1 | 11/2012 | Sturgis et al. | |
| 2013/0291326 | A1 | 11/2013 | Mintel et al. | |
| 2013/0312207 | A1 | 11/2013 | Lim et al. | |
| 2015/0257525 | A1* | 9/2015 | Kang | D01F 8/12 15/167.1 |
| 2017/0265637 | A1 | 9/2017 | Telwar | |
| 2019/0014896 | A1 | 1/2019 | Kaicker | |
| 2020/0154875 | A1 | 5/2020 | Kaicker et al. | |
| 2022/0053922 | A1 | 2/2022 | Kaicker et al. | |

OTHER PUBLICATIONS

Kaicker, Anisa Telwar; Non-Final Office Action for U.S. Appl. No. 15/457,501, filed Mar. 13, 2017, dated Apr. 30, 2019, 23 pgs. **Note: copy not provided as part of PTO records.

Kaicker, Anisa Telwar; Notice of Allowance for U.S. Appl. No. 15/457,501, filed Mar. 13, 2017, dated Apr. 20, 2020, 5 pgs. **Note: copy not provided as part of PTO records.

Kaicker, Anisa Telwar; Requirement for Restriction/Election for U.S. Appl. No. 15/457,501, filed Mar. 13, 2017, dated Mar. 8, 2019, 7 pgs. **Note: copy not provided as part of PTO records.

Kaicker, Anisa Telwar; Supplemental Notice of Allowance for U.S. Appl. No. 15/457,501, filed Mar. 13, 2017, dated Jun. 25, 2020, 6 pgs. **Note: copy not provided as part of PTO records.

Kaicker, Anisa Telwar; Non-Final Office Action for U.S. Appl. No. 16/135,421, filed Sep. 19, 2018, dated Aug. 14, 2020, 25 pgs.

Kaicker, Anisa Telwar; Requirement for Restriction/Election for U.S. Appl. No. 16/135,421, filed Sep. 19, 2018, dated May 1, 2020, 8 pgs.

Kaicker, Anisa Telwar; International Preliminary Report on Patentability for PCT Application No. PCT/US17/22261, filed Mar. 14, 2017, dated Sep. 27, 2018, 10 pgs.

Kaicker, Anisa Telwar; International Search Report and Written Opinion for PCT/US2017/022261, filed Mar. 14, 2017, dated Jun. 22, 2017, 12 pgs.

Kaicker, Anisa Telwar; Notice of Allowance for U.S. Appl. No. 16/135,421, filed Sep. 19, 2018, dated Nov. 10, 2020, 11 pgs.

Kaicker, Anisa Telwar, Restriction Requirement for U.S. Appl. No. 16/773,523, filed Jan. 27, 2020, dated Mar. 12, 2021, 7 pgs.

Kaicker, Anisa Telwar; Non-Final Office Action for U.S. Appl. No. 16/773,523, filed Jan. 27, 2020, dated Apr. 21, 2021, 23 gs.

Kaicker, Anisa Telwar; Notice of Allowance for U.S. Appl. No. 16/773,523, filed Jan. 27, 2020, dated Aug. 2, 2021, 11 pgs.

Kaicker, Anisa Telwar; Supplemental Notice of Allowance for U.S. Appl. No. 16/773,523, filed Jan. 27, 2020, dated Nov. 12, 2021, 6 pgs.

* cited by examiner

METHODS OF PROVIDING A COSMETIC BRUSH

CROSS-REFERENCE TO RELATED APPLICATIONS

The present application is a divisional of U.S. application Ser. No. 15/457,501, filed Mar. 13, 2017, now U.S. Pat. No. 10,736,410, which claims priority to U.S. Provisional Application No. 62/308,852, filed Mar. 15, 2016, both of which are hereby specifically incorporated by reference herein in their entireties.

BACKGROUND

Technical Field

This disclosure relates to fibers (aka bristles) such as used in cosmetic brushes or the like.

BRIEF SUMMARY

It is to be understood that this summary is not an extensive overview of the disclosure. This summary is exemplary and not restrictive, and it is intended neither to identify key or critical elements of the disclosure nor delineate the scope thereof. The sole purpose of this summary is to explain and exemplify certain concepts off the disclosure as an introduction to the following complete and extensive detailed description.

The present disclosure relates to a new fiber which has a triangular cross section, and which may be used as a substitute for animal hair with comparable pickup and other properties. The disclosure also relates to methods for providing same.

Generally described, the disclosure relates to a cosmetic brush, including a plurality of elongate brush bristles each having a triangular transverse cross section, such that each of said elongate brush bristles defines three substantially parallel edges along a length of each of said bristles.

Another aspect of the present disclosure may include the cosmetic brush as noted above, wherein each of said plurality of elongate brush bristles includes a free end configured for the application of cosmetics, each of said free ends having a short tip.

Another aspect of the present disclosure may include the cosmetic brush as noted above, further comprising a plurality of elongate brush bristles each having a circular transverse cross section, said plurality of elongate brush bristles each having a circular transverse cross section being intermixed with said plurality of elongate brush bristles each having a triangular transverse cross section.

Another aspect of the present disclosure may include the cosmetic brush as noted above, wherein each of said plurality of elongate brush bristles having a triangular transverse cross section includes a triangular transverse cross section which defines an equiangular triangle.

Another aspect of the present disclosure may include the cosmetic brush as noted above, wherein each of said plurality of elongate brush bristles having a triangular transverse cross section includes a triangular transverse cross section which defines an equiangular triangle having sides each having a length being greater than or equal to 0.05 mm and less than or equal to 0.1 mm.

Another aspect of the present disclosure may include the cosmetic brush as noted above, wherein each of said plurality of elongate brush bristles having a triangular transverse cross section includes a wave.

Another aspect of the present disclosure may include the cosmetic brush as noted above, wherein each of said plurality of elongate brush bristles having a triangular transverse cross section is composed of extruded Polybutylene Terephthalate.

Another aspect of the present disclosure may include a method of providing a cosmetic brush for use in the application of cosmetics, said method comprising the steps of: A) extruding a plurality of elongate brush bristles each having a triangular transverse cross section, such that each of said elongate brush bristles defines three substantially parallel edges along a length of each of said bristles; and B) combining said plurality of said bristles to provide a brush head for application of cosmetics.

Another aspect of the present disclosure may include the method as noted above, further comprising a step of extruding a plurality of elongate brush bristles each having a circular transverse cross section, and further comprising a step of intermixing said plurality of elongate brush bristles each having a circular transverse cross section with said plurality of elongate brush bristles each having a triangular transverse cross section.

Another aspect of the present disclosure may include the method as noted above, wherein each of said plurality of elongate brush bristles having a triangular transverse cross section is provided with an equiangular transverse cross section.

Another aspect of the present disclosure may include the method as noted above, wherein each of said plurality of elongate brush bristles having a triangular transverse cross section is provided with a triangular transverse cross section which defines an equiangular triangle having sides each having a transverse measured length being greater than or equal to 0.05 mm and less than or equal to 0.1 mm.

Another aspect of the present disclosure may include the method as noted above, wherein each of said plurality of elongate brush bristles having a triangular transverse cross section is provided with a wave.

Another aspect of the present disclosure may include the method as noted above, wherein each of said plurality of elongate brush bristles having a triangular transverse cross section is made of extruded Polybutylene Terephthalate.

Another aspect of the present disclosure may include the method as noted above, wherein each of said plurality of elongate brush bristles having a triangular transverse cross section is provided with a short tip by dipping a tip of each of said bristles in a solution including sodium hydroxide.

Another aspect of the present disclosure may include a method of providing a cosmetic brush for use in the application of cosmetics, said method comprising the steps of: A) extruding a plurality of elongate brush bristles each having a triangular transverse cross section, such that each of said elongate brush bristles defines three substantially parallel edges along a length of each of said the bristles; B) soaking said plurality of elongate brush bristles each having a triangular transverse cross section in water; C) dipping a tip of each said plurality of elongate brush bristles of step B in a solution including sodium hydroxide so as to provide a short tip; and D) combining said plurality of said bristles to provide a brush head configured for application of cosmetics, such that said short tips are commonly oriented and free.

Another aspect of the present disclosure may include the method as noted above, further comprising a step of extruding a plurality of elongate brush bristles each having a circular transverse cross section, and further comprising a step of intermixing said plurality of elongate brush bristles each having a circular transverse cross section with said plurality of elongate brush bristles each having a triangular transverse cross section.

Another aspect of the present disclosure may include the method as noted above, wherein each of said plurality of elongate brush bristles having a triangular transverse cross section is provided with an equiangular transverse cross section.

Another aspect of the present disclosure may include the method as noted above, wherein each of said plurality of elongate brush bristles having a triangular transverse cross section is provided with a triangular transverse cross section which defines an equiangular triangle having sides each having a transverse measured length being greater than or equal to 0.05 mm and less than or equal to 0.1 mm.

Another aspect of the present disclosure may include the method as noted above, wherein each of said plurality of elongate brush bristles having a triangular transverse cross section is provided with a wave.

Another aspect of the present disclosure may include the method as noted above, wherein in step "B", said plurality of elongate brush bristles are soaked in water for 10 minutes at room temperature.

Other aspects and advantages of the present disclosure will become obvious to the reader and it is intended that these objects and advantages are within the scope of the present invention.

ELEMENT LIST

Here is a list of the various elements:

10 Brush Assembly
20 Bristles
21 Exemplary Bristle
30 Ferrule
40 Handle
100 Extrusion plate
102 Extrusion holes

DETAILED DESCRIPTION AND BEST MODE OF IMPLEMENTATION

The present disclosure now will be described more fully hereinafter with reference to the accompanying drawings, in which some, but not all embodiments of the disclosure are shown. The invention may be embodied in many different forms and should not be construed as limited to the embodiments set forth herein; rather, these embodiments are provided so that this disclosure will satisfy applicable legal requirements. Like numbers refer to like elements throughout.

Reference is now made to the figures, in which like elements indicate like elements throughout the several views.

General Operating Environment

Figure 1:
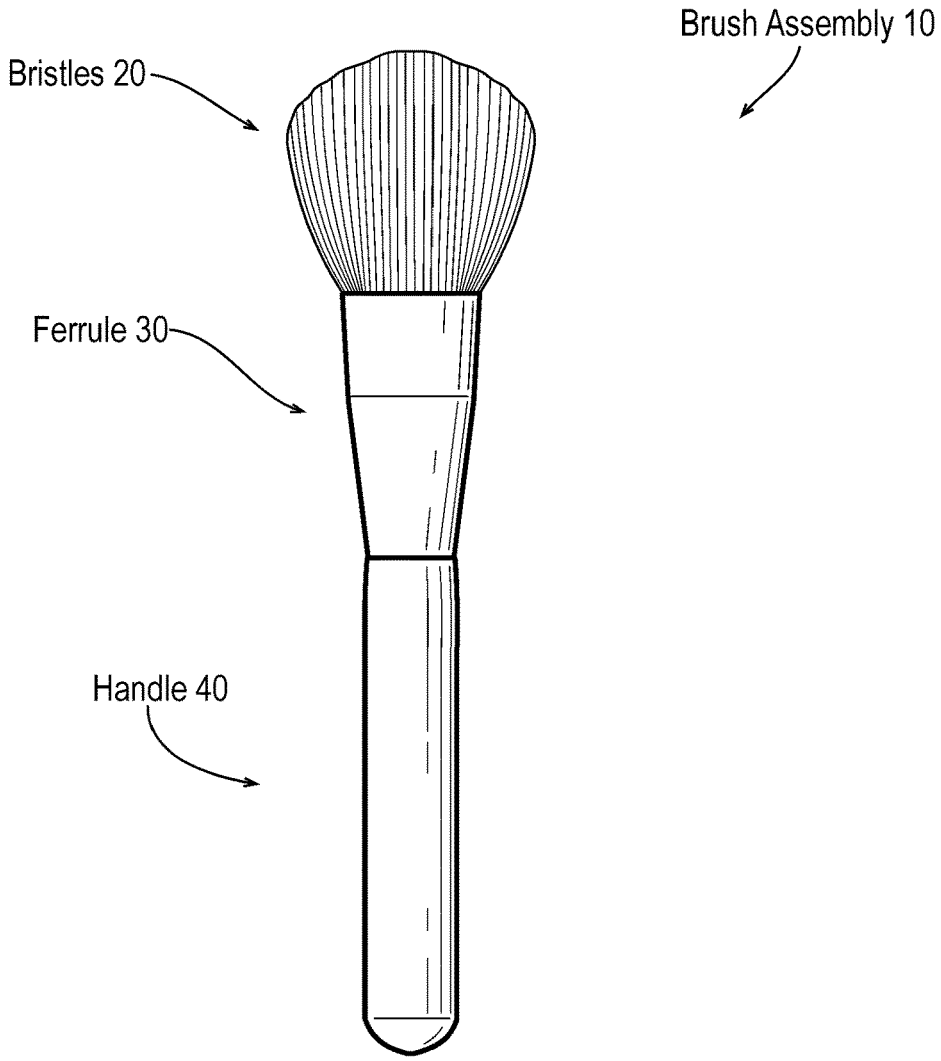
FIG. 1 illustrates an example brush assembly 10, including bristles 20, a ferrule 30, and a handle 40. The bristles 20 include multiple individual elongate bristle elements discussed in more detail later. The ferrule 30 attaches the bristles 20 relative to the handle 40, such that a user (not shown) can grasp the handle 40 and apply cosmetic product to the bristles 20, and thereafter from the bristles 20 to the user's face (not shown).

As will be seen, discussion will be made herein regarding bristles for use in cosmetic brushes of the like, said bristles having a triangular cross section. Reference is made to FIG. 1, which illustrates an example brush assembly 10, including bristles 20, a ferrule 30, and a handle 40. The bristles 20 include multiple individual elongate bristle elements. The ferrule 30 attaches the bristles 20 relative to the handle 40, such that a user (not shown) can grasp the handle 40 and apply cosmetic product to the bristles 20, and thereafter from the bristles 20 to the user's face (not shown).

The Triangular Fiber (Aka Triangular Bristle)

Figure 2:
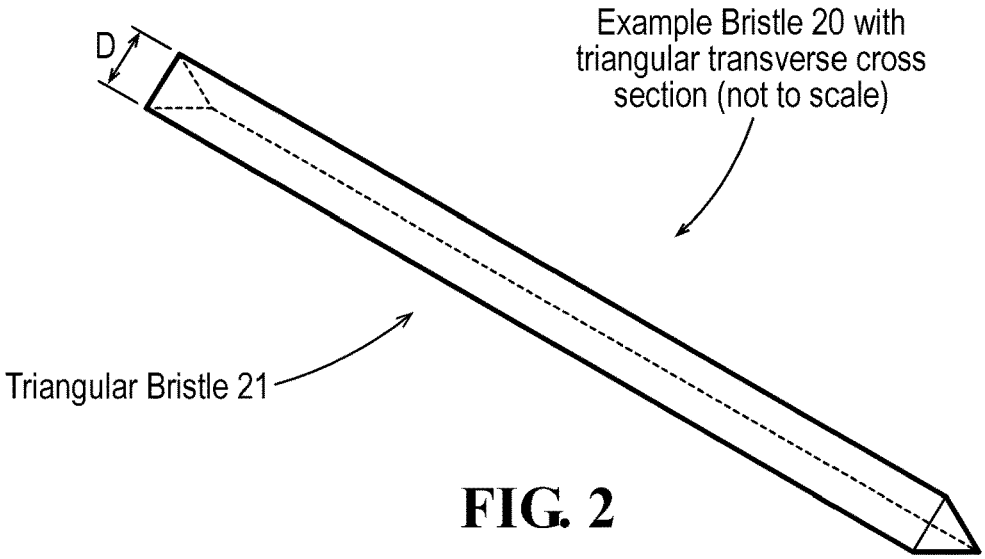
FIG. 2 illustrates an example bristle 20 (aka fiber 20) with a triangular transverse cross section. This figure is not to scale. In this embodiment the triangular transverse cross section is that of an equiangular triangle. it should be understood that an equiangular triangle is a triangle where all three interior angles are equal in measure. Because the interior angles of any triangle always add up to 180 degrees, each angle is always a third of that, or 60 degrees. The dimension D in this figure is the smallest distance (aka length) between any two of the three parallel edges of the bristle 20. These bristles are contemplated for use in the bristles 20 noted above.
Figure 3:
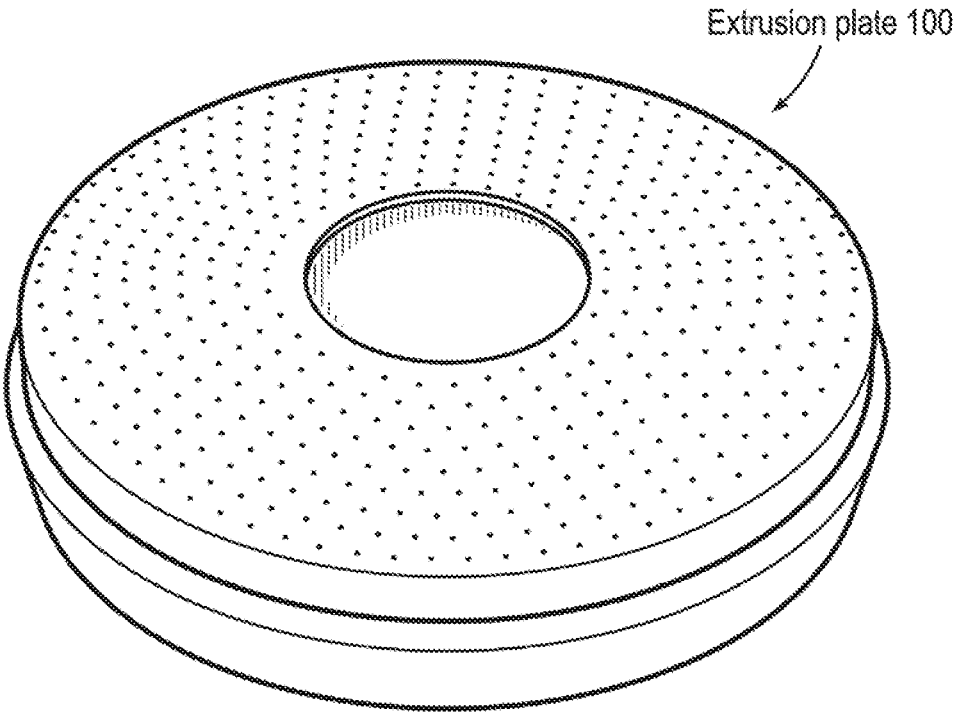
FIG. 3 illustrates an extrusion plate 100.
Figure 4:
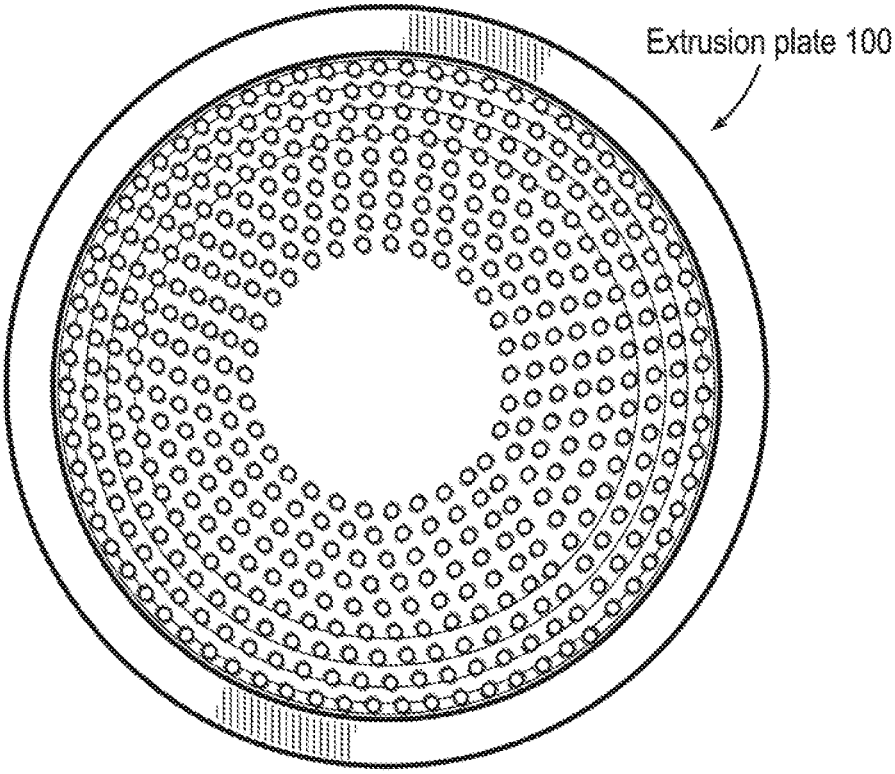
FIG. 4 illustrates the inlet side of the extrusion plate 100.
Figure 5:
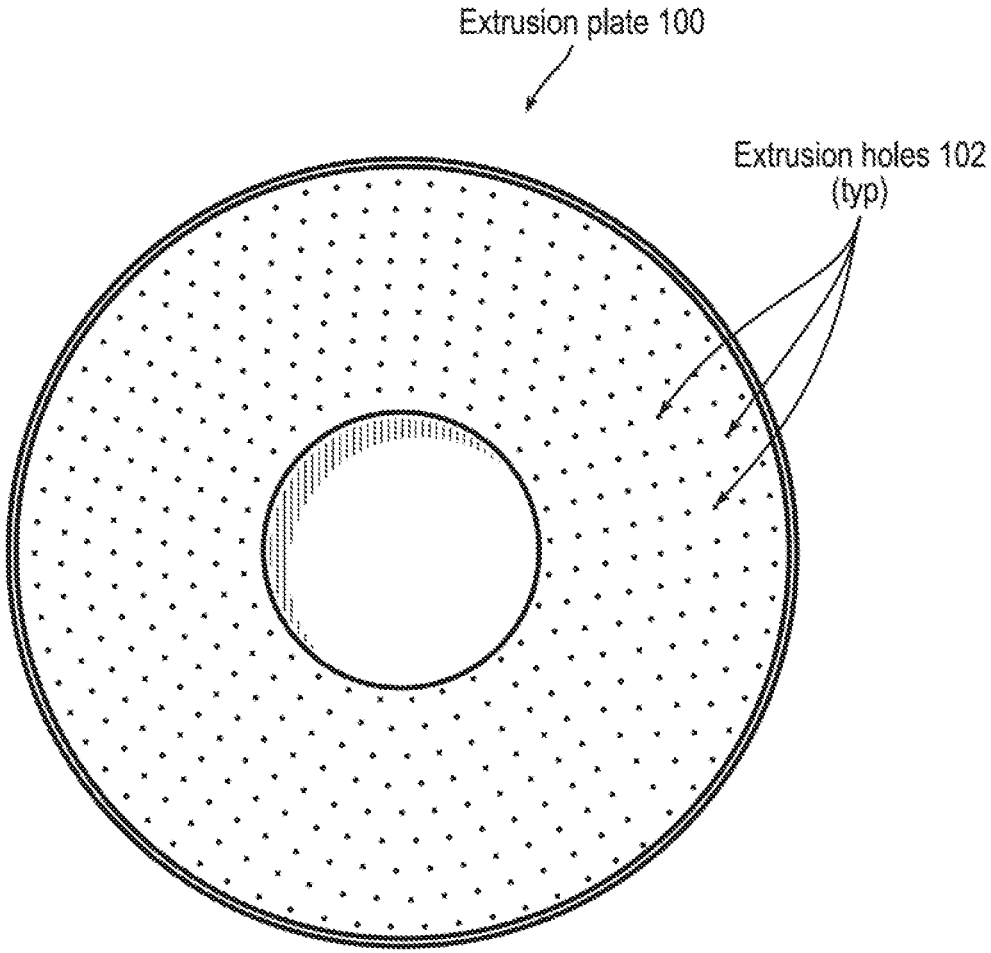
FIG. 5 illustrates the outlet side of the extrusion plate 100, which includes a plurality of extrusion holes 102.
Figure 6:
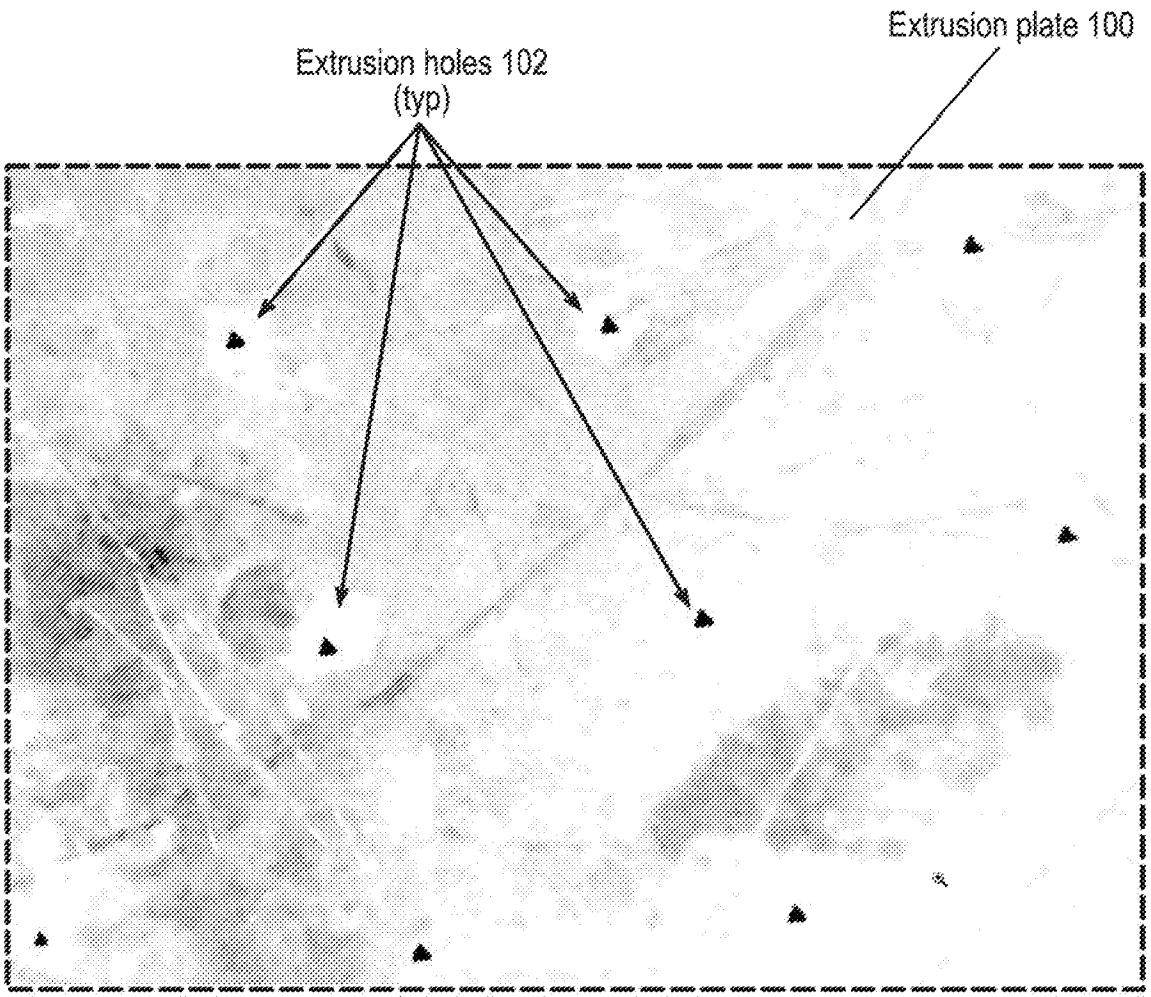
FIG. 6 is a close up partial view of that shown in FIG. 5, illustrating the extrusion holes 102 on the outlet side of the extrusion plate 100.

Reference is now made to FIG. 2, which illustrates an example triangular bristle 21 (aka triangular fiber 21) with a triangular transverse cross section. This figure is not to scale. In this embodiment the triangular transverse cross section is that of an equiangular triangle. It should be understood that an equiangular triangle is a triangle where all three interior angles are equal in measure. Because the interior angles of any triangle always add up to 180 degrees, each angle is always a third of that, or 60 degrees. The dimension D in this figure is the smallest distance (aka length) between any two of the three parallel edges of the bristle 20. These bristles are contemplated for use in the bristles 20 noted above.

Uses of the Triangular Bristles

Contemplated herein is the use of a triangular bristle such as 21 in a cosmetic brush such as brush assembly 10 in FIG. 1, to apply cosmetic products to the skin.

Mixture with Other Bristles

Under one configuration, the triangular section fibers 21 may be used alone, that is, no other types of bristles may be used in the bristles 20.

Under another configuration the triangular section fibers 21 may be used in a blend of fibers which might contain a percentage of triangular section fibers and a percentage of circular transverse section PBT fibers (such as are commonly used for makeup brushes).

Advantages of the Triangular Bristles

The cosmetic industry is getting more and more involved in environmentally friendly manufacture/products and animal cruelty issues.

For this reason, the inventors contemplate making brushes with PBT, instead of animal hair. The challenge of doing so is that the animal hair provides more powder pick up compared to conventional PBT, because the animal hair has a texture on the surface in part due to the presence of cuticles. Extruded PBT does not have such a surface texture.

The triangular bristles increase the powder pick up power of the brush, because the shape of each bristle (three parallel edges along the length of the bristle) is capable of scratching the surface of the press powder product (the triangular fiber shape "scratches" more compared to a circular section fiber).

Said another way, the triangular fiber can be used for animal hair substitution because of its ability of picking up powder better than the commonly used circular section PBT.

Dimensions of the Triangular Bristles

Reference is again made to FIG. 2, which illustrates an example bristle 20 (aka fiber 20) with a triangular transverse cross section. This figure is not to scale. In this embodiment the triangular transverse cross section is that of an equiangular triangle. It should be understood that an equiangular triangle is a triangle where all three interior angles are equal in measure. Because the interior angles of any triangle always add up to 180 degrees, each angle is always a third of that, or 60 degrees. The dimension D in this figure is the smallest distance (aka length) between any two of the three parallel edges of the bristle 20.

The sizes of the dimension D is contemplated to include the following lengths: 0.05 mm, 0.06 mm, 0.07 mm, 0.08 mm 0.09 mm, and 0.1 mm. Another way of saying this is that the triangular transverse cross sections which define an equiangular triangle have sides each having a transverse measured length being greater than or equal to 0.05 mm and less than or equal to 0.1 mm. Each of these sizes would provide different advantages.

Composition of Fibers

The composition of the fibers is in one configuration to be PBT (Polybutylene Terephtalate).

However, other materials and better resins are contemplated.

Some cosmetic filaments are made with Nylon, although the elasticity and retention of the material is not as good as PBT.

DuPont has two cosmetic filaments named Sorona and Natrafil. The two are not PBT and they could be extruded in a triangular section.

Extrusion of Fibers

The manufacture of the fibers is done by PBT extrusion techniques such as known in the art, such as using a triangular plate tooling to achieve the triangular PBT section of the fiber.

A "wave" can be provided in the fiber and is achieved with a conventional crimping method.

The Tipping Process as Applied to Round Bristles

Disclosed is the use of a NaOH solution used to dip the tips of the hair into to eat away at the tips which gives the fiber a softer feel on the face. This may be understood as providing a "short" tip to the fiber/bristle.

In one embodiment of the present disclosure, a chemical tipping process is used to provide similar short tips to the synthetic fiber. Here is a description of the "short tip" tipping process for the following two types of PBT fibers having round cross sections:

0.05 mm diameter, 40 mm long 0.07 mm diameter, 40 mm long

Hair Dimension 0.05 mm Diameter, 40 mm Long

Figure 7:
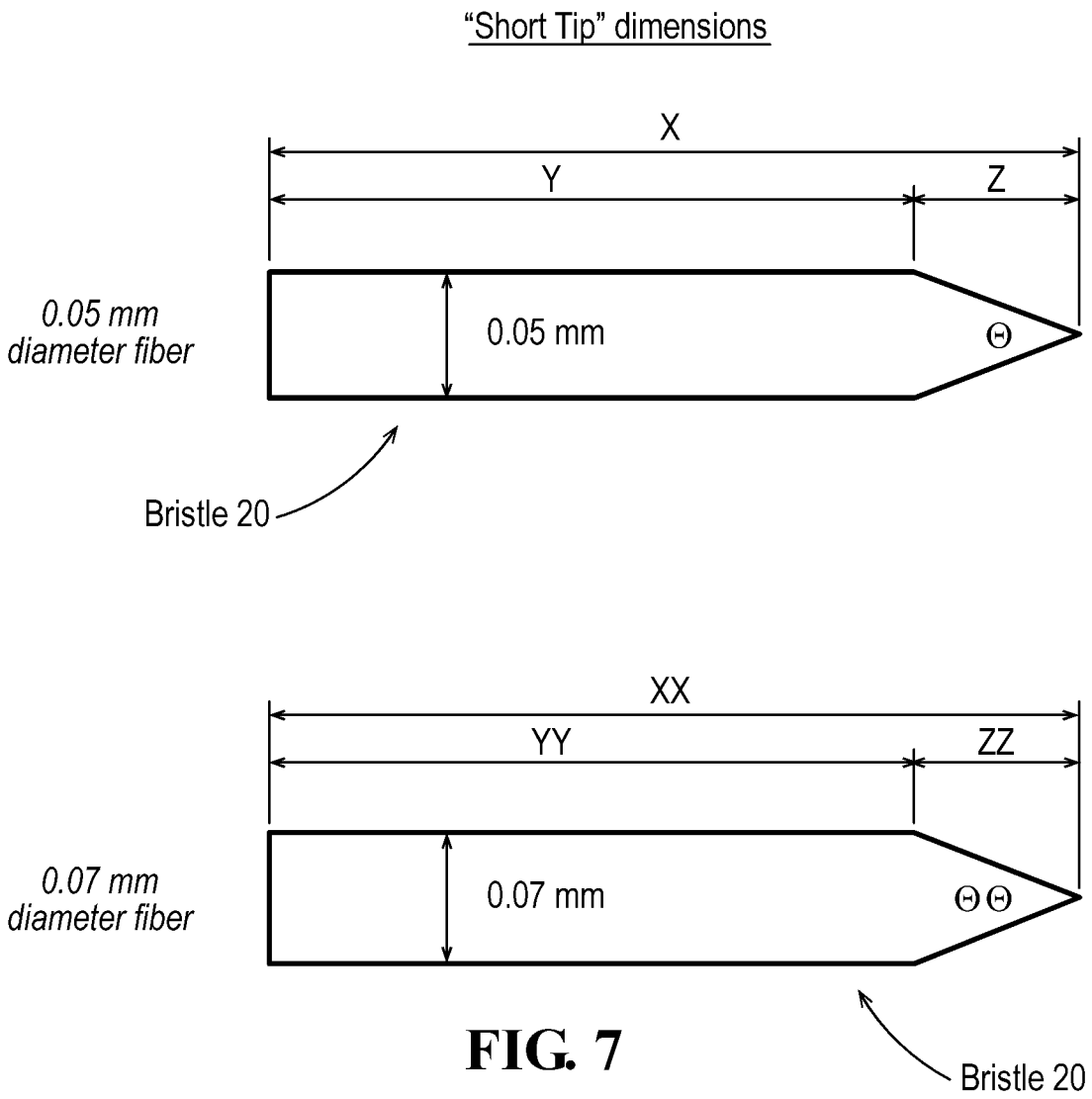
FIG. 7 shows various "short" tip dimensions for PBT round cross section fibers/bristles.

Reference is made to FIG. 7. Here are certain specifications for this diameter fiber and its related tipping processes:

Tip type: Short Tip

Tipping solution: NaOH (Sodium hydroxide), having a concentration of 44.5+/−2, diluted with water.

Concentration: 44.5+/−2 percent

Temperature: 135° C.+/−2 degrees C.

Time: 17 min+/−1 min

Length tip is dipped into solution 5 mm-6 mm+/−1 mm

Final tip length 1 mm+/−0.2 mm

The process is as follows A PBT fiber having a dimension of 0.06 mm diameter and 40 mm long is suspended from above a tipping solution such that a downwardly extending end of the fiber can be dipped into the solution. The tipping solution is NaOH (sodium hydroxide) having a concentration of 44.5+/−2, diluted with water, at a temperature of 135° C.+/−2. The downwardly extending end of the fiber is dipped into the tipping solution for about 17 min+/−1 min. The length of the tip which is dipped into solution is 5 mm-6 mm+/−1 mm. The final tip length is approximately 1 mm+/−0.2 mm. Said another way, the solution removes approximately 4 mm and 1 mm is left. This is the Z dimension in FIG. 7.

Hair Dimension 0.07 nm Diameter, 40 mm Long

Reference is made to FIG. 7. Here are certain specifications for this diameter fiber and its related tipping processes:

Tip type: Short Tip

Tipping solution: NaOH (Sodium hydroxide), having a concentration of 44.5+/−2, diluted with water.

Concentration: 44.5+/−2 percent

Temperature: 132° C.+/−2 degrees C.

Time: 17 min+/−1 min

Length tip is dipped into solution 5 mm-6 mm+/−1 mm

Final tip length: 1 mm+/−0.2 mm

The process is as follows A PBT fiber having a dimension of 0.075 mm diameter and 40 mm long is suspended from above a tipping solution such that a downwardly extending end of the fiber can be dipped into the solution. The tipping solution is NaOH (sodium hydroxide) having a concentration of 44.5+/−2, diluted with water, at a temperature of 132 degrees C.+/−2 degrees. The downwardly extending end of the fiber is dipped into the tipping solution for about 17 min+/−1 min. The length of the tip which is dipped into solution is 5 mm-6 mm+/−1 mm. The final tip length is approximately 1 mm+/−0.2 mm. Said another way, the solution removes approximately 4 mm and 1 mm is left. This is the ZZ dimension in FIG. 7.

The Tipping Process as Applied to Triangular Bristles

As noted above NaOH is a solution used to dip the tips of the round bristles into to eat away at the tips which gives the fiber a softer feel on the face.

For the triangular bristles, it's a little different.

A normal PBT fiber bundle (with circular cross sections) is dense, while the triangular fiber bundle is less dense, due to the shape of the fiber.

With less density, the fibers more easily soak with and absorb the NaOH solution. So there is a need to better control the process to avoid the triangular fiber bundle absorbing too much NaOH solution. This is done by soaking the material in water before it is "tipped".

The bundle is soaked in water for 10 minutes at room temperature. Otherwise the tipping process for the round bristles is used.

CONCLUSION

Various modifications and variations can be made in the present invention without departing from the spirit or scope of the invention.

One should note that conditional language, such as, among others, "can," "could," "might," or "may," unless specifically stated otherwise, or otherwise understood within the context as used, is generally intended to convey that certain embodiments include, while other embodiments do not include, certain features, elements and/or steps. Thus, such conditional language is not generally intended to imply that features, elements and/or steps are in any way required for one or more particular embodiments or that one or more particular embodiments necessarily include logic for deciding, with or without user input or prompting, whether these features, elements and/or steps are included or are to be performed in any particular embodiment. It should be emphasized that the above-described embodiments are merely possible examples of implementations, merely set forth for a clear understanding of the principles of the present disclosure. Any process descriptions or blocks in flow diagrams should be understood as representing modules, segments, or portions of code which include one or more executable instructions for implementing specific logical functions or steps in the process, and alternate implementations are included in which functions may not be included or executed at all, may be executed out of order from that shown or discussed, including substantially concurrently or in reverse order, depending on the functionality involved, as would be understood by those reasonably skilled in the art of the present disclosure. Many variations and modifications may be made to the above-described embodiment(s) without departing substantially from the spirit and principles of the present disclosure. Further, the scope of the present disclosure is intended to cover any and all combinations and sub-combinations of all elements, features, and aspects discussed above. All such modifications and variations are intended to be included herein within the scope of the present disclosure, and all possible claims to individual aspects or combinations of elements or steps are intended to be supported by the present disclosure.

That which is claimed is:

1. A method of providing a cosmetic brush for use in the application of cosmetics, said method comprising the steps of:

A) extruding a plurality of elongate brush bristles each having a triangular transverse cross section, such that each of said elongate brush bristles defines three substantially parallel edges along a first length of each of said bristles, each of said elongate brush bristles tapering along a second length of the bristle to define a short tip, wherein a length of each of the short tips is between about 0.8 mm and 1.2 mm; and B) combining said plurality of said bristles to provide a brush head configured for the application of cosmetics.

2. The method of claim 1, further comprising a step of extruding a plurality of elongate brush bristles each having a circular transverse cross section, and further comprising a step of intermixing said plurality of elongate brush bristles each having a circular transverse cross section with said plurality of elongate brush bristles each having a triangular transverse cross section.

3. The method of claim 1, wherein each of said plurality of elongate brush bristles having a triangular transverse cross section is provided with an equiangular transverse cross section.

4. The method of claim 1, wherein each of said plurality of elongate brush bristles having a triangular transverse cross section is provided with a triangular transverse cross section which defines an equiangular triangle having sides each having a transverse measured length being greater than or equal to 0.05 mm and less than or equal to 0.1 mm.

5. The method of claim 1, wherein each of said plurality of elongate brush bristles has a triangular transverse cross section is provided with a wave.

6. The method of claim 1, wherein each of said plurality of elongate brush bristles having a triangular transverse cross section is made of extruded Polybutylene Terephthalate.

7. The method of claim 1, wherein the short tip is provided by dipping a tip of each of said bristles in a solution including sodium hydroxide.

8. The method of claim 1, wherein the first length is at least about 10 times greater than the second length.

9. The method of claim 8, wherein each of said plurality of elongate brush bristles defines a length of about 40 mm.

10. A method of providing a cosmetic brush for use in the application of cosmetics, said method comprising the steps of:

A) extruding a plurality of elongate brush bristles each having a triangular transverse cross section, such that each of said elongate brush bristles defines three substantially parallel edges along a length of each of said bristles;

B) soaking said plurality of elongate brush bristles each having a triangular transverse cross section in water;

C) dipping a tip of each of said plurality of elongate brush bristles of step B in a solution including sodium hydroxide so as to provide a short tip, each of the short tips defining a length of between about 0.8 mm and 1.2 mm; and D) combining said plurality of said bristles to provide a brush head configured for the application of cosmetics, such that said short tips are commonly oriented and free.

11. The method of claim 10, further comprising a step of extruding a plurality of elongate brush bristles each having a circular transverse cross section, and further comprising a step of intermixing said plurality of elongate brush bristles each having a circular transverse cross section with said plurality of elongate brush bristles each having a triangular transverse cross section.

12. The method of claim 10, wherein each of said plurality of elongate brush bristles having a triangular transverse cross section is provided with an equiangular transverse cross section.

13. The method of claim 10, wherein each of said plurality of elongate brush bristles having a triangular transverse cross section is provided with a triangular transverse cross section which defines an equiangular triangle having sides each having a transverse measured length being greater than or equal to 0.05 mm and less than or equal to 0.1 mm.

14. The method of claim 10, wherein each of said plurality of elongate brush bristles having a triangular transverse cross section is provided with a wave.

15. The method of claim 10, wherein in step "B", said plurality of elongate brush bristles are soaked in water for 10 minutes at room temperature.

16. The method of claim 10, wherein a length of each elongate brush bristle not including the short tip is at least about 10 times greater than the length of the short tip.

17. The method of claim 16, wherein each of said plurality of elongate brush bristles defines a length of about 40 mm.

* * * * *